US005493178A

United States Patent [19]

Byram et al.

[11] Patent Number: 5,493,178

[45] Date of Patent: Feb. 20, 1996

[54] LIQUID COOLED FLUID CONDUITS IN A COLLECTOR FOR AN ELECTRON BEAM TUBE

[75] Inventors: Jody L. Byram, Easton; Stephen E. Thompson, Doylestown; Kenneth S. Karsten, Jr., Bethleham; Richard C. Wertman, Allentown, all of Pa.

[73] Assignee: Triton Services, Inc., Dunkirk, Md.

[21] Appl. No.: 146,310

[22] Filed: Nov. 2, 1993

[51] Int. Cl.[6] ..... H01J 23/033

[52] U.S. Cl. ..... 315/5.38; 313/22; 313/36

[58] Field of Search ..... 315/5.38; 313/35, 313/36, 22

[56] References Cited

U.S. PATENT DOCUMENTS

| | | | |
|---|---|---|---|
| 3,098,165 | 7/1963 | Zitelli | 315/5.38 X |
| 3,227,904 | 1/1966 | Lenin | 315/5.38 X |
| 3,260,885 | 7/1966 | Crapuchettes | 315/5.38 |
| 3,305,742 | 2/1967 | McCune | 313/36 X |
| 3,317,780 | 5/1967 | Ayers | 315/5.38 X |
| 3,374,523 | 3/1968 | LaRue | 315/5.38 X |
| 5,227,694 | 7/1993 | Wertman | 315/5.38 |
| 5,283,534 | 2/1994 | Bohlen et al. | 315/5.38 X |

FOREIGN PATENT DOCUMENTS

| | | | |
|---|---|---|---|
| 214327 | 9/1986 | Japan | 315/5.38 |

*Primary Examiner*—Benny T. Lee
*Attorney, Agent, or Firm*—Plevy & Associates

[57] ABSTRACT

A liquid cooled collector for an electron beam tube. The collector includes a dielectric body through which is formed a central cavity. Within the central cavity are disposed at least one electrode that dissipates the impinging electron beam. The electrodes are thermally coupled to the dielectric body. As such, when the electrodes absorb the electron beam, the resulting heat is conducted into the dielectric body. A plurality of fluid conduits are disposed around the dielectric body wherein at least one side of each conduit is defined by the dielectric body. Furthermore, an input manifold and an output manifold are also partially defined by the dielectric body and interconnect each of the fluid conduits. Each of the fluid conduits extend separately from a point along the input manifold to a point along the output manifold. Consequently, by providing a flow of coolant into the input manifold, the coolant flows through each of the fluid conduits into the output manifold, thereby cooling separate regions of the dielectric body. Since all the fluid conduits are contained within the casing of the collector, the collector is liquid cooled in a very space-efficient manner. In addition, since the heat conduction paths through the dielectric material to the fluid conduits are very short, the fluid conduits absorb heat in a highly efficient manner.

11 Claims, 7 Drawing Sheets

LIQUID COOLED FLUID CONDUITS IN A COLLECTOR FOR AN ELECTRON BEAM TUBE

BACKGROUND OF THE INVENTION

1. Field of the Invention

The present invention relates to an electron collector for an electron beam tube, and more particularly to such electron collectors that are liquid cooled in a space efficient manner and provide superior operating characteristics.

2. Description of the Prior Art

Electron beam tube devices, such as traveling-wave tubes (TWTs), klystrons and the like are in wide spread use in many different technologies. Such electron beam tube devices conventionally possess four basic elements, namely an electron gun, an RF interaction circuit, a magnetic electron-beam focusing system and a collector. The function of the collector is to collect the electron beam, after it has passed through the interaction circuit, and dissipate the remaining beam energy. As the electron beam passes through the interaction circuit, the electron beam typically loses various amounts of energy. However, an electron beam typically maintains more than half of its original energy as the electron beam impinges upon the collector. The absorption of the electron bombardment by the collector causes the collector to heat, thereby requiring the collector to be cooled.

The overall efficiency of many electron beam tube devices can be increased by operating the collector at a voltage lower than the electron beam voltage. Such collectors are known in the art as "depressed collectors". Depressed collectors introduce a potential difference between the interaction circuit and the collector. However, in a single-stage collector the amount by which the collector can be depressed is limited by the energy of the electron beam impinging upon the collector. The potential drop between the interaction circuit and the collector can be no greater than the amount of energy possessed by the slowest electrons contained within the electron beam, otherwise the electrons will be turned away from the collector and re-enter the interaction structure, causing oscillations.

The efficiency of an electron beam tube device can be further increased by introducing multiple depressed-collector stages. Multiple collector stages allow for the collection of the lowest energy electrons at one stage, while allowing those with more energy to be collected at secondary stages that are depressed at a higher bias. Consequently, the degree by which the collector can be depressed is not as severely limited by the energy of the electron beam, as in a single-stage collector.

When electron tube devices are miniaturized to fit certain applications, the electron collectors are also miniaturized. With a miniaturized electron collector, there is not much space available that can be dedicated to heat sinks or heat exchanges. Consequently, to prevent overheating of the collector or to prevent the collector from causing adjacent electronic components to overheat, the power dissipated by the collector is limited so as to not exceed the thermal capacity of the overall system. It will therefore be understood that by actively cooling the collector, the collector can dissipate greater amounts of heat and the electron beam tube device can run in higher power applications and at higher efficiencies. One of the most efficient ways to actively cool a collector is through the use of a liquid coolant. However, conventional liquid cooling schemes are not space efficient and are therefore not readily adapted to miniaturized applications.

In U.S. Pat. No. 3,260,885 to Crapuchettes, entitled ANODE STRUCTURES PROVIDING IMPROVED COOLING FOR ELECTRON DISCHARGE DEVICES, a collector is described wherein a single helical coolant pathway is formed around the periphery of a metal collector element. A coolant liquid is pumped through the coolant pathway thereby cooling the collector element. Since the collector element is a single metal piece, the collector element acts as a single stage collector and does not embody the advantages of a multi-stage depressed collector. Furthermore, since the coolant follows only a single path around the collector element, the coolant must be rapidly pumped through the coolant pathway in order to adequately cool the collector element, and prevent the coolant from overheating. Lastly, the creation of a helical coolant pathway around a collector element is very difficult, especially if the collector is a miniaturized component.

U.S. Pat. No. 3,970,891 to Heynisch et al, entitled ELECTRON COLLECTOR FOR AN ELECTRON BEAM TUBE and U.S. Pat. No. 3,388,281 to Arnaud, entitled ELECTRON BEAM TUBE HAVING A COLLECTOR ELECTRODE INSULATIVELY SUPPORTED BY A COOLING CHAMBER, both show collectors having coolant chambers formed around the periphery of the collector. In both patents, the presence of the coolant chamber adds significantly to the size of the collector device, therefore making the collector element impractical for many miniaturized applications.

In Russian Patent 656127, a collector is described having tubing wrapped around the exterior of the collector body. Coolant is pumped through the tubing cooling the collector. The tubing adds to the size of the overall collector, therefore making the collector impractical for many miniaturized applications. Furthermore, the coolant tubes are on the exterior of the collector. As such heat must travel across the entire width of the collector before it can be absorbed by the coolant.

In each of the prior art patents set forth above, the collectors described are single-stage collectors having a single set electrode design. None of the patents disclose a multi-stage depressed collector or a collector with a flexible electrode design. When a collector is designed for a given application, the theoretical design usually requires several experimental iterations before the collector is properly matched to the application. As such, there exists a need in the prior art for a multi-staged collector that has a flexible design and can be selectively altered into several internal electrode configurations. Furthermore, the need exists for such a flexible multi-staged collector that is liquid cooled in a manner that dissipates a large amount of heat without occupying a large amount of space.

It is therefore an objective of the present invention to provide an electron beam tube collector that can be selectively altered to include any number of depressed stages and includes a liquid cooling construction that removes large amounts of heat from the collector without significantly adding to the size of the collector.

It is also an objective of the present invention to provide a electron beam tube collector that is easier to manufacture, is more reliable and operates at higher temperatures than comparable prior art collectors of an equal size.

SUMMARY OF THE INVENTION

The present invention is an electron beam collector for an electron beam tube. The collector includes a dielectric body through which is formed a central cavity. Within the central cavity are disposed at least one electrode that dissipates the impinging electron beam. The electrodes are thermally coupled to the dielectric body. As such, when the electrodes absorb the electron beam, the resulting heat is conducted into the dielectric body. A plurality of fluid conduits are disposed around the dielectric body wherein at least one side of each conduit is defined by the dielectric body. Furthermore, an input manifold and an output manifold are also partially defined by the dielectric body and interconnect each of the fluid conduits. Each of the fluid conduits extend separately from a point along the input manifold to a point along the output manifold. Consequently, by providing a flow of coolant into the input manifold, the coolant flows through each of the fluid conduits into the output manifold, thereby cooling separate regions of the dielectric body. In a preferred embodiment, the dielectric body is surrounded by a conductive casing that forms an RF shield around the collector. The various fluid conduits are formed by creating channels in either the dielectric body and/or the conductive casing, whereby each of the fluid conduits is defined by both the dielectric body and the conductive casing. Since all the fluid conduits are contained within the casing of the collector, the collector is liquid cooled in a very space-efficient manner. In addition, since the heat conduction paths through the dielectric material to the fluid conduits are very short, the fluid conduits absorb heat in a highly efficient manner. Furthermore, each of the fluid conduits flows from the input manifold to the output manifold along a separate path. As such, the coolant in each of the fluid conduits passes across only a short portion of the dielectric material. This prevents the coolant from overheating and ensures the rapid and equal cooling to all regions of the collector.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
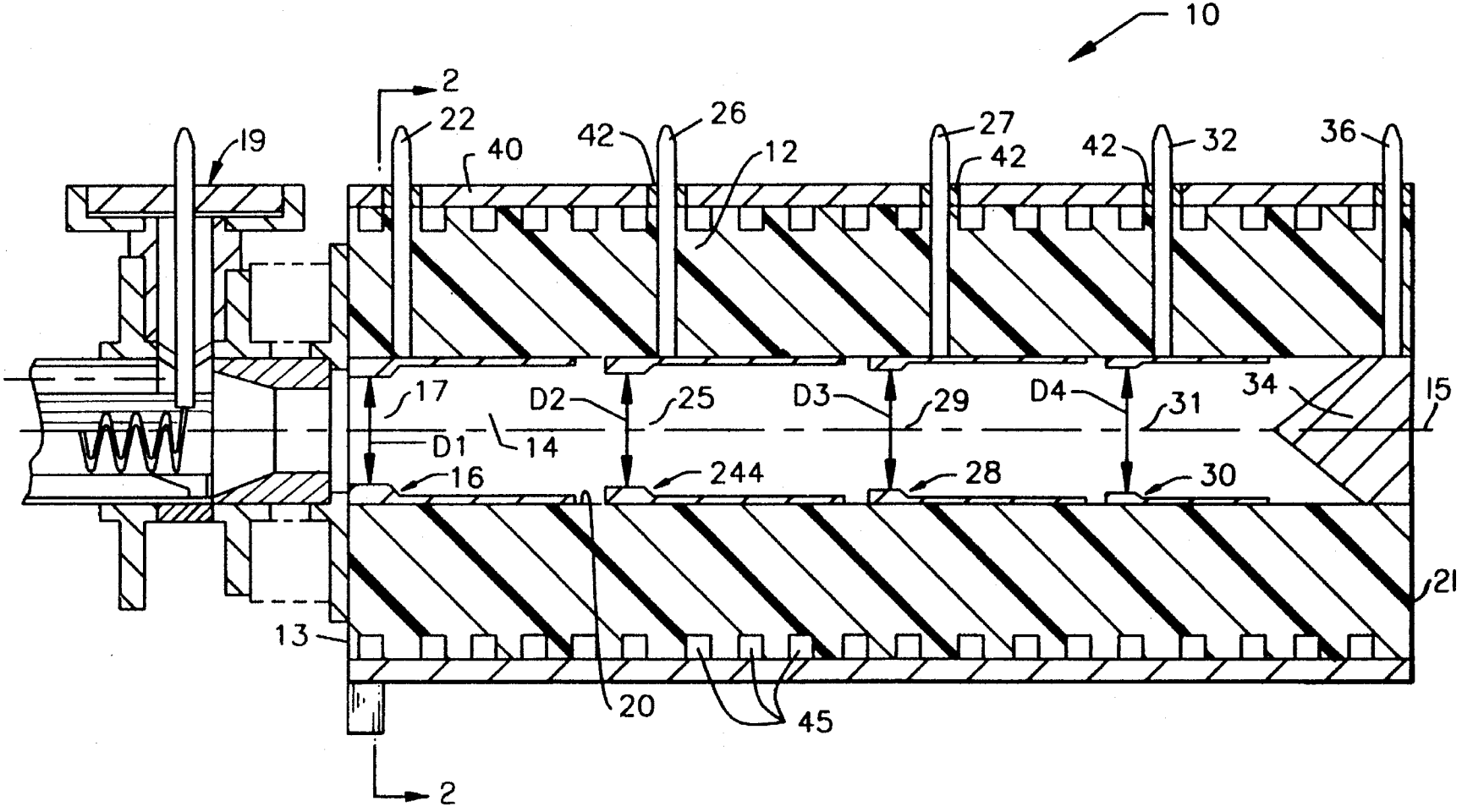
FIG. 1 is a side cross-sectional view of one preferred embodiment of the present invention collector.

Referring to FIG. 1, there is shown one preferred embodiment of the present invention collector 10 that can be used within any linear beam tube assembly, such as a traveling-wave tube (TWT), klystron or the like. The collector 10 includes a hollow dielectric or ceramic body 12 that defines a central cavity 14. The ceramic body 12 is preferably formed of a highly thermally conductive ceramic material such as aluminum nitride or beryllium oxide. The central cavity 14 is cylindrically shaped, being symmetrically formed around the longitudinal mid-axis 15 of the ceramic body 12 and passing from the front surface 13 of the ceramic body 12 to the opposite back surface 21. A plurality of conductive electrodes are symmetrically disposed around the mid-axis 15 of the ceramic body 12 within the central cavity 14. Although any plurality of electrodes can be used, in the shown embodiment, the collector 10 is a five stage depressed collector, having five separate electrodes within the central cavity 14.

The first electrode 16 is positioned at the first end 13 of the central cavity 14 proximate an electron beam tube 19. The first electrode 16 is cylindrical and is affixed to the inner surface 20 of the central cavity 14. The first electrode defines an aperture 17, having a diameter D1, that aligns with the electron pathway within the electron beam tube 19. As such, an electron beam emanating from the electron beam tube 19 can enter the central cavity 14 by passing through the aperture 17. The first electrode 16 is electrically coupled to a first feed-through connector 22 that extends through ceramic body 12 and electrically couples the first electrode 16 to a point external of the collector 10.

A second cylindrical electrode 24 is disposed behind the first electrode 16 within the central cavity 14. The second electrode 24 defines an aperture 25, having a diameter D2 that is larger than the diameter D1 of the aperture 17 defined by the first electrode 16. A second feed-through connector 26 is electrically coupled to the second collector body 24. The second feed-through connector 26 extends through the ceramic body 12 and electrically couples the second electrode 24 to a point external of the collector 10.

A third and fourth electrode 28, 30 are aligned behind the second electrode 24, respectively. The third electrode 28 defines an aperture 29, having a diameter D3, that is larger than the diameter D2 of aperture 25 defined by the second electrode 24. A third feed-through connector 27 extends through the ceramic body 12 of the collector 10, electrically coupling the third electrode 28 to a point external of the collector 10. The fourth electrode 30 defines an aperture 31, having a diameter D4, that is larger than the diameter D3 of aperture 29 defined by the third electrode 28. A fourth feed-through connector 32 extends through the ceramic body 12 of the collector 10, coupling the fourth electrode 30 to a point external of the collector 10.

A fifth electrode 34 is positioned at the end of the central cavity 14, opposite the electron beam tube 19. The fifth electrode 34 obstructs the central cavity 14, in a air impervious manner and is coupled to a fifth feed-through connector 36 that extends through the ceramic body 12 of the connector 10 and joins the fifth electrode 34 to a point external of the collector 10. Each of the five electrodes 16, 24, 28, 30, 34 shown are symmetrically disposed around the mid-axis 15 of the central cavity 14. Since the mid-axis 15 of the central cavity 14 is aligned with the path of the electron beam entering the central cavity 14 from the electron beam tube 19, each of the electrodes 16, 24, 28, 30, 34 is symmetrically disposed around the path of the electron beam.

Since the shown embodiment has five separate electrodes 16, 24, 28, 30, 34, it will be understood that the shown embodiment represents a five-stage collector. However, the use of five stages in the shown embodiment is merely exemplary and any number of stages may be constructed. The electrodes 16, 24, 28, 30, 34 can be attached to the inner surface 20 of the central cavity 14 in any known manner. For instance, each of the collector bodies can be press fit into place or the inner surface 20 can be metalized in places allowing the collector bodies to be brazed onto the ceramic body 12. Furthermore, as will later be described, the dimensions of each of the electrodes 16, 24, 28, 30, 34 can be selectively altered without varying the shape of the collector 10. As such the collector's performance can be optimized for a specific application without changing the size or shape of the collector 10.

A metal casing 40 surrounds the outside of the ceramic body 12. The metal casing 40 provides an RF shield around collector 10. Small insulated grommets or plugs 42 are positioned within the metal casing 40 surrounding each of the feed-through connectors 22, 26, 27 32, 36. The insulated plugs 42 electrically insulate each of the feed-through connectors from the metal casing 40 as each of the feed-through connectors pass through the metal casing 40. A plurality of coolant channels 45 are formed in the ceramic body 12 proximate the metal casing 40. Each of the coolant channels 45 follow the periphery of the ceramic body 12 and are defined on three sides by the ceramic body 12 and on one side by the metal casing 40. In the shown embodiment the coolant channels 45 have square cross-sectional profiles, however this shape is merely exemplary and any other geometric configuration can also be used. As will be explained, each of the coolant channel 45 are directed in parallel around the ceramic body 12 so as to evenly cool the ceramic body 12.

Figure 2:
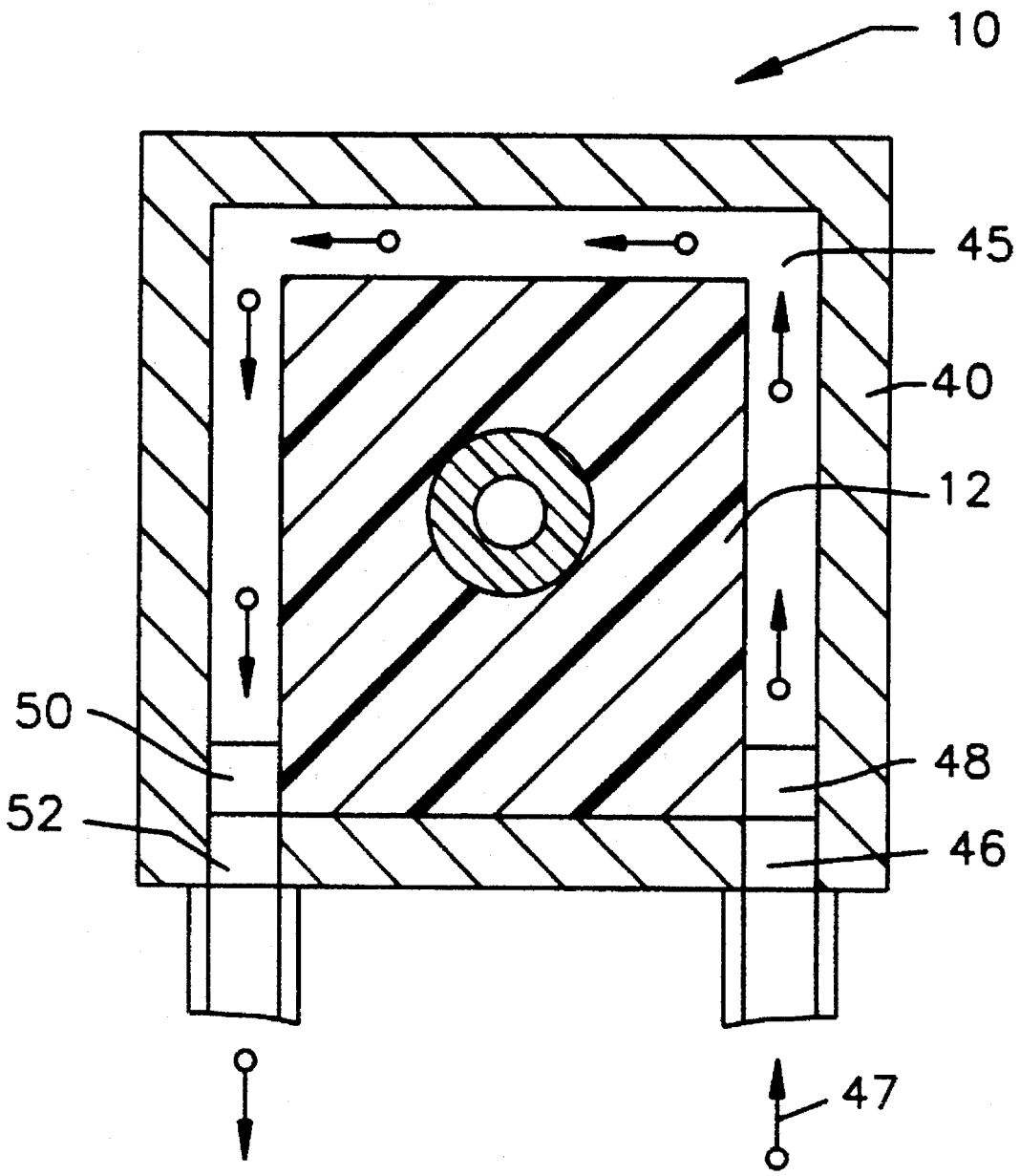
FIG. 2 is a forward cross-sectional view of the embodiment of FIG. 1, viewed along section line 2—2.

Referring to FIG. 2, a forward cross-sectional view of the collector 10 is shown exposing the first of the coolant channels 45. As can be seen the coolant channel 45 follows the periphery of ceramic body 12 and the inside surface of metal casing 40. Coolant, represented by arrow 47, enters the collector 10 through a first aperture 46 in the metal casing 40. The fluid entering the collector 10 then fills an input manifold 48 that interconnects each of the coolant channels 45 in the collector 10. Coolant then flows through each of the coolant channels 45 from the input manifold 48 and drains into an output manifold 50 on the opposite side of the collector 10. The output manifold 50 also interconnects all the coolant channels 45, leading the flow of all the coolant to an output aperture 52 in metal casing 40.

Figure 3:
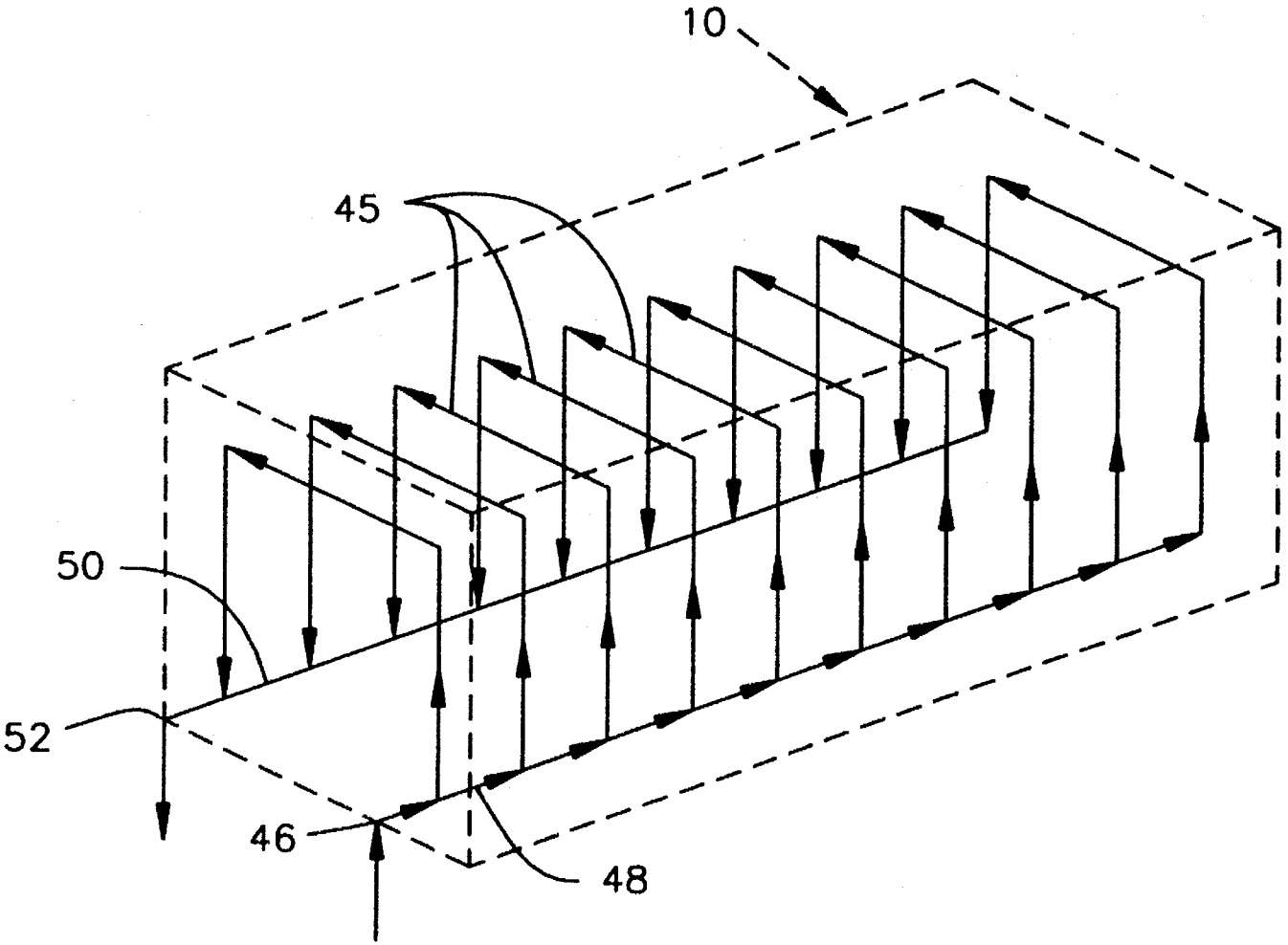
FIG. 3 is perspective schematic view of the present invention collector, illustrating the direction of the flow of coolant through the collector's structure.

The flow of coolant through the collector 10 is best understood by referring to FIG. 3. In FIG. 3 it can be seen schematically that each of the coolant channels 45 lay in parallel planes, wherein each of the coolant channel 45 follows the circumferential shape of the ceramic body below the metal casing. Coolant enters the collector 10 through the input aperture 46. The fluid flows into the input manifold 48 supplying each of the coolant channels 45. The coolant flows through each of the coolant chambers 45 and drains into the output manifold 50. The output manifold 50 leads to the output aperture 52 where the coolant leaves the collector 10.

As can be seen, coolant flows through each of the coolant channels 45 independently. As a result, the temperature of the coolant is generally equivalent in each of coolant channels 45. This enables all parts of the collector 10 to be substantially equally cooled and prevents one region of the collector 10 from being cooled more rapidly than another region. The presence of the coolant channels 45 within the structure of the collector 10 ensures short conduction paths from the various electrodes to the coolant channels 45. Furthermore, since the coolant channels 45 are surrounded by the structure of the collector 10, heat from the collector 10 can conduct into the coolant channels 45 from all four side surfaces of the coolant channels. The combined short conduction pathways and large surface area of the coolant channels 45 permits for the efficient transfer of heat from the collector 10 to the coolant in a highly space efficient manner. For example, supposing the present invention were a collector for a miniaturized traveling-wave tube, such as F-2323 TWT currently manufactured by ITT Corp., the assignee herein, the present invention collector can be manufactured having a length of 1.250 inches and a width and height of 0.40 inches. At this size the collector would still being able to properly collect the output of the TWT even under worst case conditions, without overheating. Furthermore, the coolant passes through each coolant channel 45 independently as the coolant flows from the input manifold 48 to the output manifold 50. As such, the heat transfer to the coolant is limited by the short flow path of the coolant. Since the coolant flows through each of the coolant channels 45 separately, the temperature of the coolant in each of the coolant channels 45 is generally equivalent. As a result, the volume of coolant flow can be greatly reduced as compared to systems having only a single flow path. Consequently, the flow capacity of the coolant channels 45 can be reduced below that found in prior art, thereby taking less space in the collector 10 and allowing the collector 10 to be cooled in a space-efficient manner. Since the present invention collector 10 is capable of dissipating more heat for a given size than conventional prior art collectors, the present invention collector 10 can operate at higher power levels and at a higher efficiency.

When a collector for electron beam tube is designed into a miniaturized electronic assembly, other components are designed into the assembly assuming the collector will be of a predetermined size and shape. Initially the electrode configuration within the collector is designed utilizing a known mathematical theorem. However, when applied to a specific application, several experimental interactions are required to optimize the design. In order to optimize the electrode configuration within the collector, the dimensions and materials of the various collector bodies may have to be adjusted. In the present invention, the various electrodes are selectively placed within the central cavity of the collector. Consequently, different sized electrodes can be added to the collector without changing the size or shape of the collector, and the collector can be optimized to a specific application. For example, suppose a theoretical electrode design called for a five-stage collector, having five electrodes of various dimensions. Now supposing that after several experimental iterations, it was determined that the collector would be more efficient using a different electrode configuration or even a four-stage collector. With the present invention, any such modification can be produced within the collector without changing the shape of the exterior of the collector. Consequently, a change in collector design will not effect size and will not produce any adverse effects on the overall design of the system into which the collector is placed.

Figure 4:
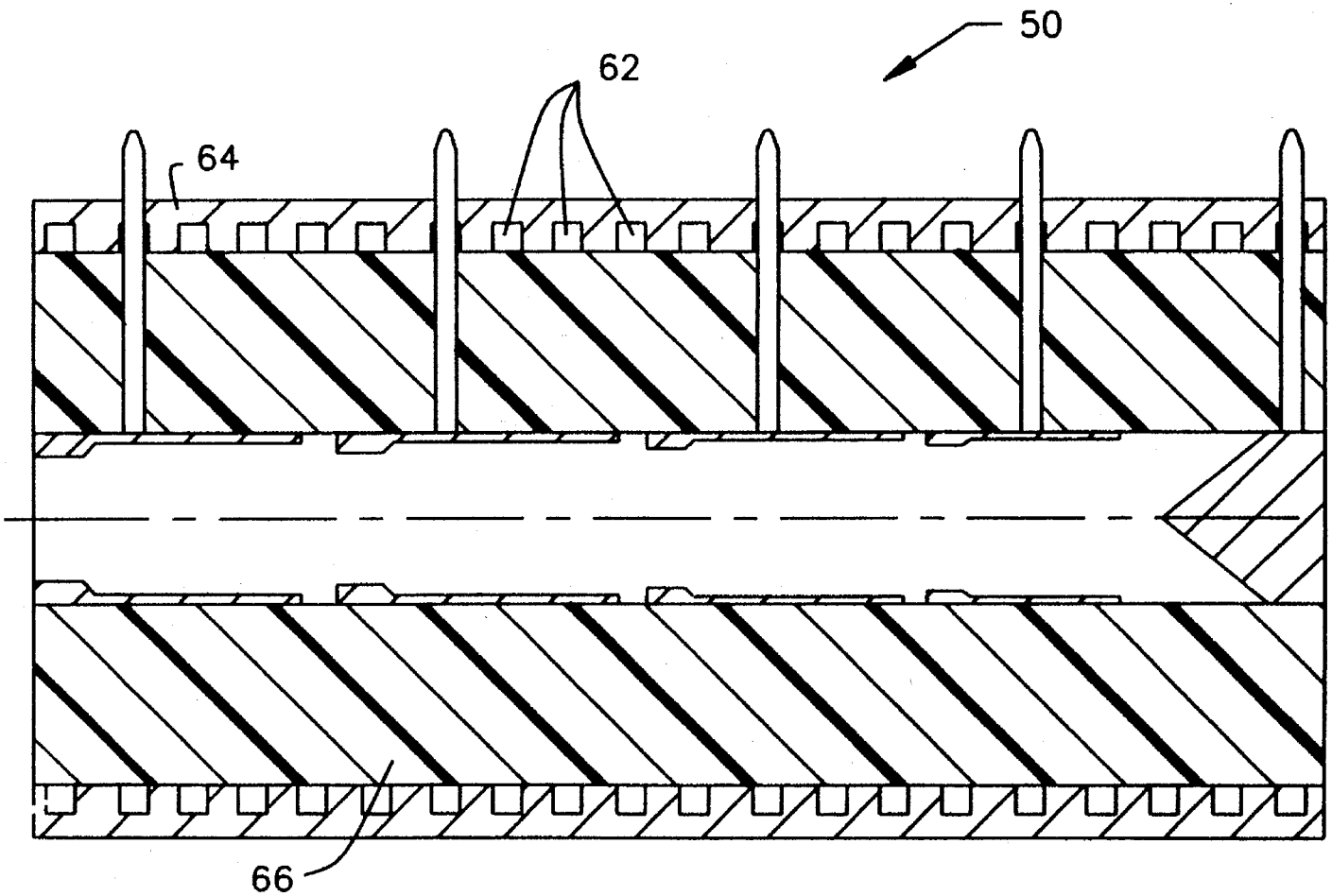
FIG. 4 is a side cross-sectional view of a second exemplary embodiment of the present invention collector.

Referring to FIG. 4, there is shown an alternate embodiment of the present invention collector 50. This embodiment is identical to the embodiment of FIG. 1, except the coolant channels 62 are formed in the metal casing 64 rather than in the ceramic body 66. The circumference of the ceramic body 66 is smooth along each of sides. As such, each of the coolant channels 62 are defined on three sides by the metal casing 64 and along one side by the ceramic body 66. The coolant channels 62 are in the same position as in the previous embodiment and function in the same manner.

Figure 5:
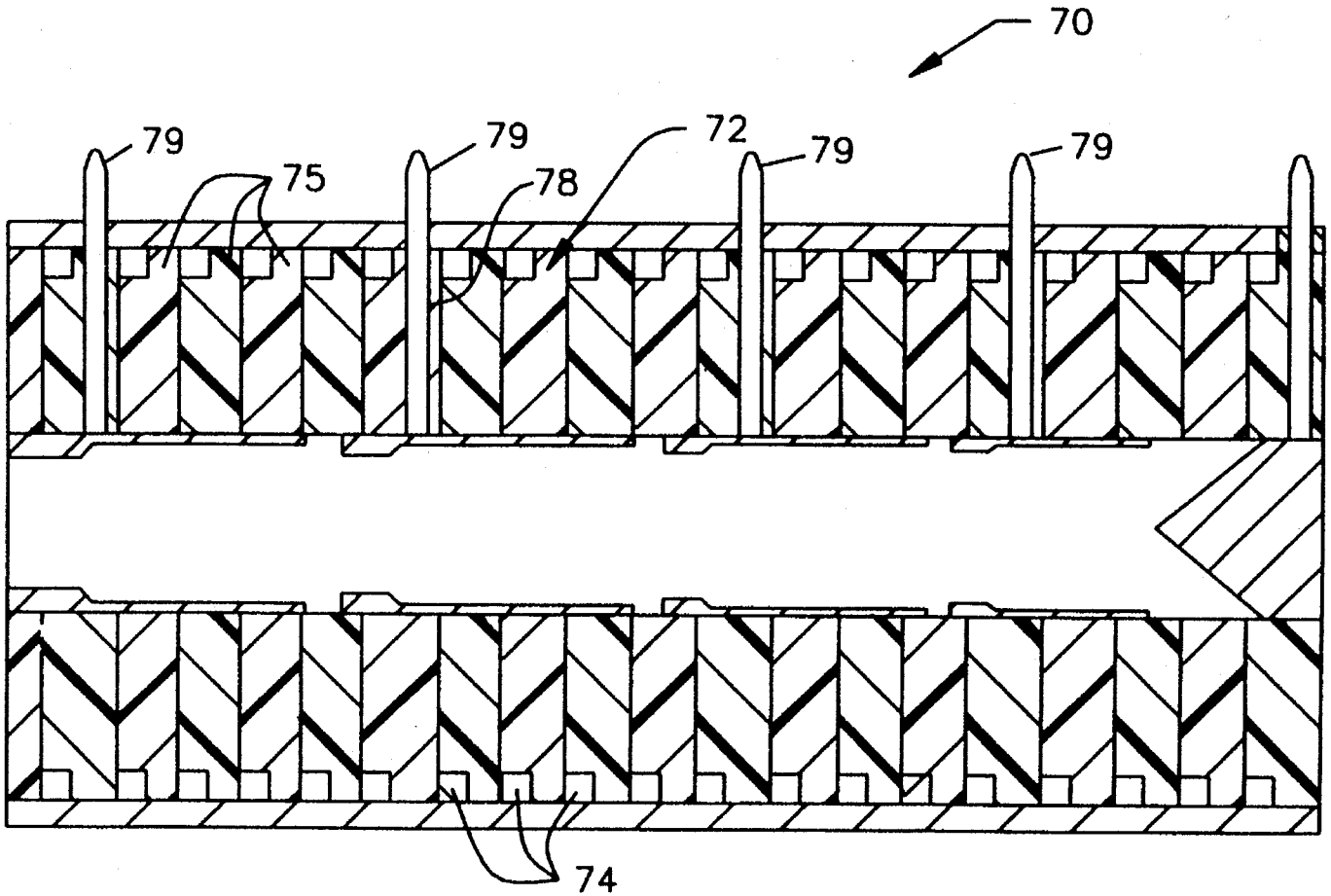
FIG. 5 is a side cross-sectional view of a third exemplary embodiment of the present invention collector.

Referring to FIG. 5, a third embodiment of the present invention collector 70 is shown, wherein the ceramic body 72 of the collector 70 is comprised of multiple ceramic elements 75 stacked against one another. Such a construction greatly increased the ease by which the coolant channels 74 can be formed into the ceramic body 72. Since the various ceramic elements 75 are manufactured separately, the ceramic elements 75 can be molded, machined or otherwise formed with the coolant channel 74 as part of the overall shape. Similarly, certain of the ceramic elements 75 may be manufactured with apertures 78 through which the feed-through connectors 79 can pass. As such, the ceramic body 72 can be constructed by stacking the proper sequence of ceramic elements 75 so that a coolant channel 74 is formed between each of the ceramic elements 75 and the apertures 78 for the feed-through connectors 79 align in the proper positions. The various ceramic elements 75 can be attached to one another in any conventional manner that produces a fluid and air impermeable seal between each of the elements 75. The collector bodies and feed-through connectors 79 are then brazed or otherwise assembled into the collector 70 as has been previously described.

Figure 6:
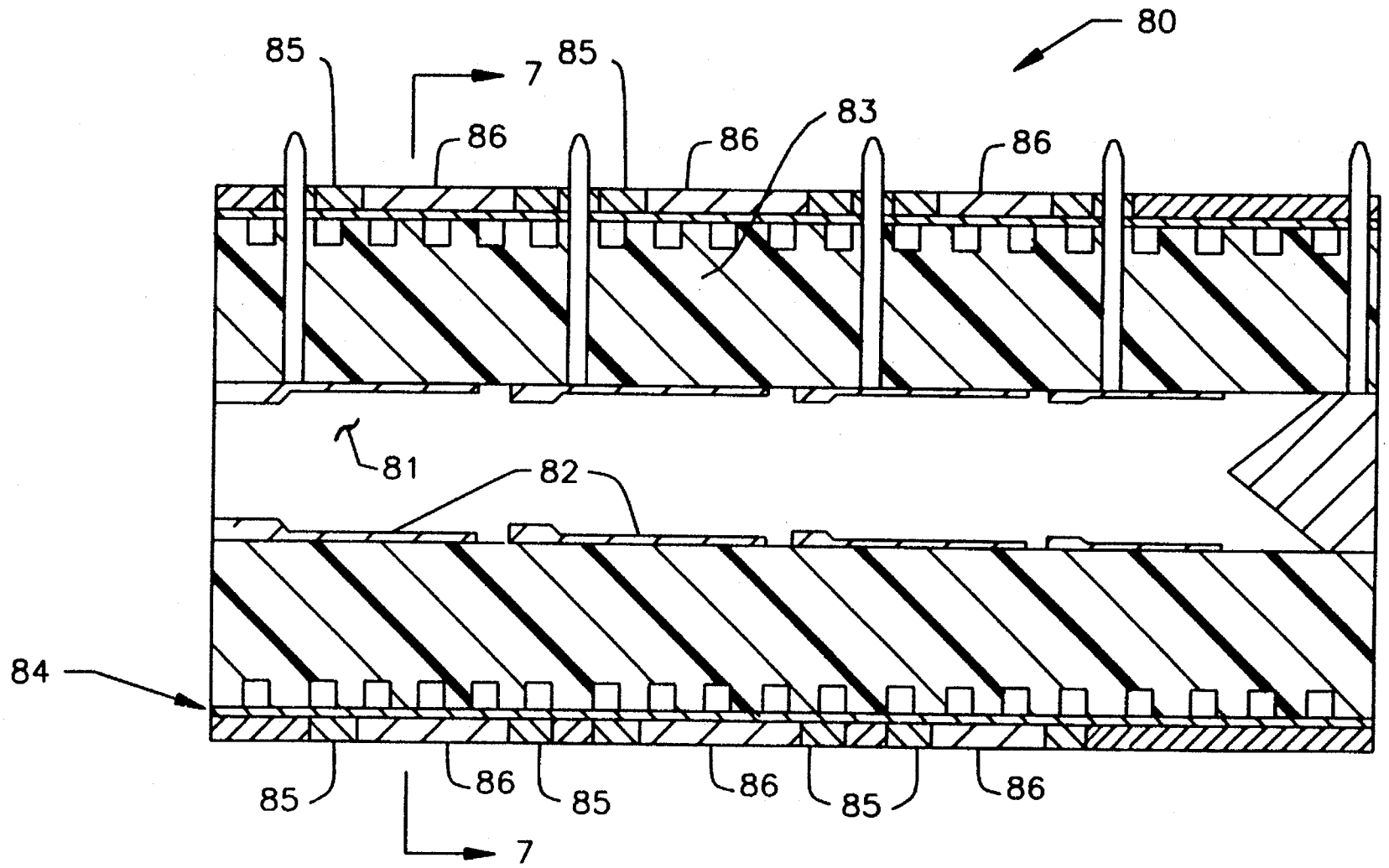
FIG. 6 is a side cross-sectional view of a fourth exemplary embodiment of the present invention collector.

In the previously described embodiments, the present invention collector has been depicted as having a square profile. In some applications, a circular profile is preferred in the collector. A circular path is optimum for coolant flow and allows for magnetic focusing to aid in the electrostatic design of the collector. Referring to FIG. 6, a collector 80 is shown having a cylindrical shape. The central cavity 81 and the position of the collector bodies 82 is exactly as has been previously described. However, the ceramic body 83 of the shown embodiment is cylindrical in shape. Furthermore, pole pieces 85 and focusing magnets 86 can be placed around the ceramic body 83 as needed. Since the ceramic body 83 is cylindrical, the influence of the focusing magnets 86 on the electrons within the central cavity 81 is uniform.

Figure 7:
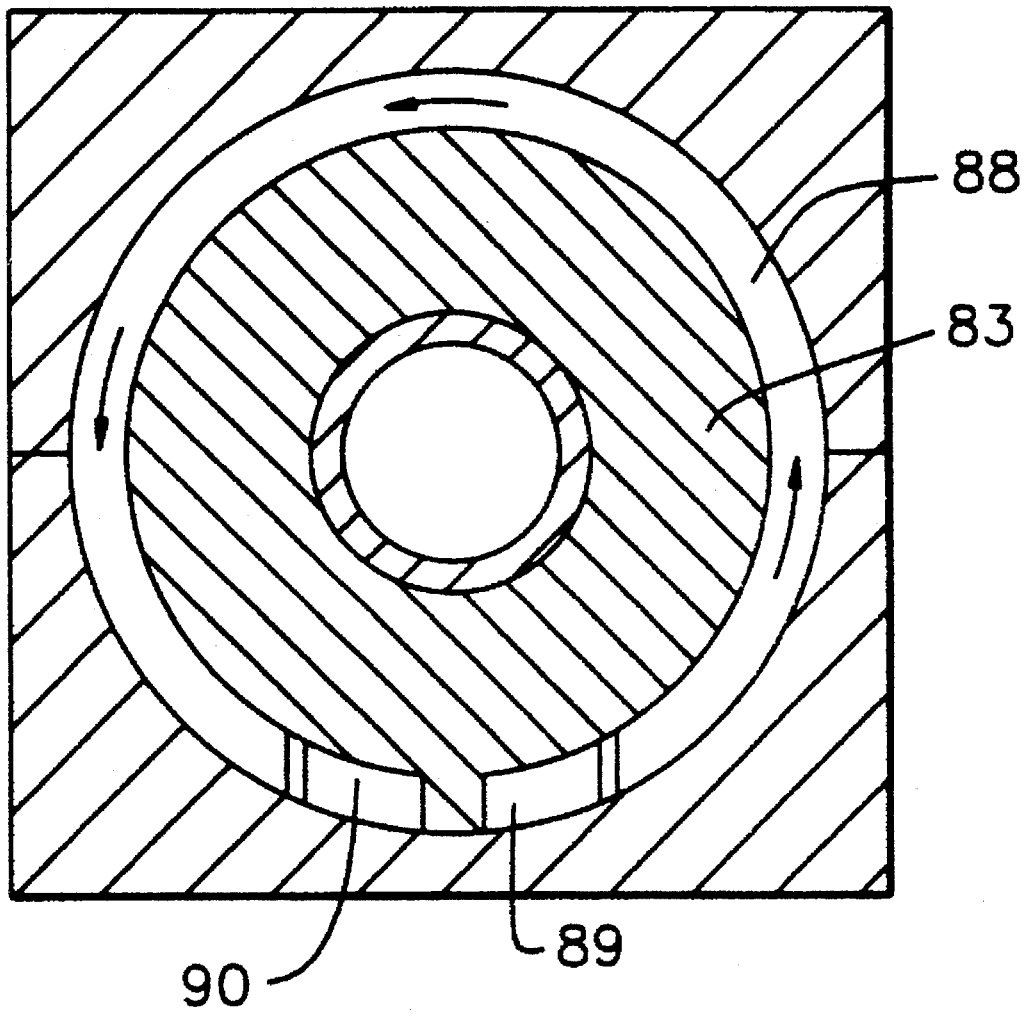
FIG. 7 is a forward cross-sectional view of the embodiment of FIG. 6, viewed along section line 7—7.

Referring to FIG. 7 in conjunction with FIG. 6, it can be seen that the shape of the coolant channels 88 is also circular, thereby following the circumference of the ceramic body 83. An inlet manifold 89 interconnects each of the coolant channels 88 at one end of the circular pattern. An outlet manifold 90 interconnects each of the coolant channels 88 at the opposite end of the circular pattern. As such, coolant flows through the inlet manifold 89, flows through each of the coolant channels 88 and flows out through the outlet manifold 90. A thin conductive shield 84 (FIG. 6) similar to that shown in FIG. 1 creates a liquid tight seal.

In view of the multitude of differing embodiments described above, it should appear obvious that a person skilled in the art could combine elements for each embodiment and produce an electron beam collector not specifically described herein. It should therefore be understood that the embodiments described herein are merely exemplary and that a person skilled in the art may make such variations and modifications without departing from the spirit and scope of the invention. All possible combination of the features of the disclosed embodiments and other obvious variations and modifications regarding differing physical geometries, proportions or materials are intended to be included within the scope of the invention as defined in the appended claims.

What is claimed is:

1. A liquid cooled collector device for collecting an electron beam produced by an electron beam tube, comprising:

a dielectric body having a central cavity disposed along a longitudinal axis therein for receiving said electron beam;

at least one conductive electrode disposed within said central cavity, wherein said at least one conductive electrode is thermally coupled to said dielectric body; and a plurality of fluid conduits through which coolant flows, wherein each of said fluid conduits has at least one wall integral with said dielectric body and said dielectric body electrically insulates said at least one conductive electrode from said coolant; and a thermally conductive metal casing surrounding said dielectric body, said casing having a plurality of grooves disposed thereon, wherein said grooves substantially define said plurality of fluid conduits between said dielectric body and said casing.

2. The collector device according to claim 1, wherein said at least one electrode is arranged as a multi-stage collector.

3. The collector device according to claim 1, further including an input manifold for supplying coolant to an input associated with each of said plurality of fluid conduits and an output manifold for draining coolant from an output associated with each of said plurality of fluid conduits, said input manifold and said output manifold being generally parallel to said longitudinal axis wherein said input manifold and said output manifold are defined by said casing and said dielectric body.

4. The collector device according to claim 3, wherein each of said plurality of fluid conduits independently extend from said input manifold to said output manifold.

5. The collector device according to claim 4, wherein each of said plurality of fluid conduits extends from said input manifold to said output manifold in a plane that is generally perpendicular to said longitudinal axis.

6. The collector device according to claim 1, wherein said dielectric body material is comprised of a plurality of dielectric members stacked against one another within said casing.

7. The collector device according to claim 6, wherein each of said plurality of dielectric members have reliefs disposed thereon that define said plurality of fluid conduits within said casing.

8. The collector device according to claim 1, wherein said dielectric body includes metalized regions within said central cavity and said at least one conductive electrode are coupled to said metalized regions.

9. The collector device according to claim 1, further including at least one connector means for electrically connecting said at least one conductive electrode to a point external of said dielectric body.

10. The collector device according to claim 1, wherein said at least one conductive electrode comprises multiple conductive electrodes, each of said conductive electrodes being electrically insulated from one another.

11. The collector device according to claim 1, wherein said dielectric body is selected from a group of materials consisting of beryllium oxide and aluminum nitrate.

* * * * *